US007563074B2

(12) United States Patent
Xu

(10) Patent No.: US 7,563,074 B2
(45) Date of Patent: Jul. 21, 2009

(54) IMPELLER FOR A CENTRIFUGAL COMPRESSOR

(75) Inventor: Cheng Xu, Huntersville, NC (US)

(73) Assignee: Ingersoll-Rand Company, Montvale, NJ (US)

( * ) Notice: Subject to any disclaimer, the term of this patent is extended or adjusted under 35 U.S.C. 154(b) by 471 days.

(21) Appl. No.: 11/531,297

(22) Filed: Sep. 13, 2006

(65) Prior Publication Data

US 2007/0059179 A1 Mar. 15, 2007

Related U.S. Application Data

(60) Provisional application No. 60/716,769, filed on Sep. 13, 2005.

(51) Int. Cl.
*F04D 29/30* (2006.01)

(52) U.S. Cl. ..... 416/185; 416/238; 416/243; 416/223 B; 415/173.1

(58) Field of Classification Search ..... 415/173.1, 415/131; 416/185, 238, 243, 223 B
See application file for complete search history.

(56) References Cited

U.S. PATENT DOCUMENTS

| | | | | |
|---|---|---|---|---|
| 2,354,653 A | | 8/1944 | Allen | |
| 2,484,554 A | | 10/1949 | Concordia et al. | |
| 3,019,736 A | | 2/1962 | Stalker | |
| 3,260,443 A | | 7/1966 | Garnett et al. | |
| 3,759,628 A | * | 9/1973 | Kempf | 415/225 |
| 4,093,401 A | | 6/1978 | Gravelle | |
| 4,167,369 A | | 9/1979 | Ishihara | |
| 4,264,271 A | | 4/1981 | Libertini | |
| 4,693,669 A | * | 9/1987 | Rogers, Sr. | 415/143 |
| 5,002,461 A | * | 3/1991 | Young et al. | 416/183 |
| 5,112,195 A | | 5/1992 | Cox | |
| 5,730,582 A | | 3/1998 | Heitmann | |
| 6,340,291 B1 | | 1/2002 | Reckert | |

(Continued)

FOREIGN PATENT DOCUMENTS

| | | |
|---|---|---|
| CH | 306142 | 3/1955 |

(Continued)

OTHER PUBLICATIONS

ASME Turbo Expo 2002: Land, Sea and Air, "A Turbomachinery Blade Design and Optimization Procedure," C. Xu and R.S. Amano, Jun. 3-6, 2002.

*Primary Examiner*—Ninh H Nguyen
(74) *Attorney, Agent, or Firm*—Michael Best & Friedrich LLP

(57) ABSTRACT

An impeller rotatable in a direction of rotation in a centrifugal compressor including an intake ring. The impeller includes a back plate having a shaft portion and a plurality of blades. Each blade extends from the back plate and includes an inducer portion adapted to draw fluid into the impeller and including a leading edge and an exducer portion adapted to discharge the fluid from the impeller and including a trailing edge. A blade pressure side is defined between the leading edge, the trailing edge, the back plate, and a blade tip. The pressure side is convex from the back plate to the blade tip. A blade suction side opposite the pressure side is defined between the leading edge, the trailing edge, the back plate, and the blade tip. The suction side being concave from the back plate to the blade tip.

28 Claims, 5 Drawing Sheets

U.S. PATENT DOCUMENTS

| | | | | |
|---|---|---|---|---|
| 6,506,015 | B2 * | 1/2003 | Nagata et al. | 415/173.1 |
| 6,629,556 | B2 * | 10/2003 | Decker et al. | 164/35 |
| 2004/0052644 | A1 | 3/2004 | Decker et al. | |
| 2006/0275113 | A1 * | 12/2006 | Chen | 415/206 |

FOREIGN PATENT DOCUMENTS

| | | | |
|---|---|---|---|
| DE | 3801203 | | 8/1989 |
| GB | 2067677 | | 7/1981 |
| GB | 2224083 | | 4/1990 |
| JP | 55064194 | A | 5/1980 |
| JP | 57198397 | A | 12/1982 |
| JP | 58119998 | A | 7/1983 |
| JP | 58195099 | A | 11/1983 |

* cited by examiner

IMPELLER FOR A CENTRIFUGAL COMPRESSOR

RELATED APPLICATION DATA

This application claims benefit under 35 U.S.C. Section 119(e) of co-pending U.S. Provisional Application No. 60/716,769 filed Sep. 13, 2005, which is fully incorporated herein by reference

BACKGROUND

The invention relates to an impeller for a centrifugal compressor. More particularly, the invention relates to an impeller that includes aerodynamic surfaces.

Centrifugal compressors include an impeller that is driven by a prime mover such as a high speed electric motor. The impeller draws in the fluid to be compressed, accelerates the fluid to a high velocity and discharges the fluid. The fluid velocity is then reduced in a diffuser, volute, and/or other associated components. As the fluid velocity is reduced, the pressure increases.

The impeller includes aerodynamic surfaces (i.e., blades, vanes, fins, etc.) that interact with the fluid being compressed to change the velocity and pressure of the fluid. The efficiency with which the aerodynamic surfaces accelerate the fluid directly impacts the overall efficiency of the fluid compression system. In addition, the design of the aerodynamic surfaces can affect the minimum and the maximum flow rates of fluid through the impeller.

SUMMARY

In one embodiment, the invention provides an impeller rotatable in a direction of rotation in a centrifugal compressor having an intake ring. The impeller includes a back plate having a hub portion and a plurality of blades that extend from the back plate. Each blade includes a leading edge that extends radially outward along a non-linear path from adjacent the hub portion.

In another construction, the invention provides an impeller rotatable in a direction of rotation in a centrifugal compressor including an intake ring. The impeller includes a back plate having a shaft portion and a plurality of blades. Each blade extends from the back plate and includes an inducer portion adapted to draw fluid into the impeller and including a leading edge, and an exducer portion adapted to discharge the fluid from the impeller and including a trailing edge. A blade pressure side is defined between the leading edge, the trailing edge, the back plate, and a blade tip. The pressure side is convex from the back plate to the blade tip. A blade suction side opposite the pressure side is defined between the leading edge, the trailing edge, the back plate, and the blade tip. The suction side is concave from the back plate to the blade tip.

In yet another construction, the invention provides a centrifugal compressor that includes an impeller rotatable in a direction of rotation about an axis. The impeller includes a plurality of blades that define an inducer portion adapted to draw in fluid during rotation, and an exducer portion adapted to discharge the fluid during rotation. Each of the blades includes a leading edge, a trailing edge, a platform portion, and a blade tip. An intake ring has a seal surface disposed adjacent the blade tip to define a clearance gap. The seal surface and the blade tip are arranged such that the gap is non-uniform when measured normal to the seal surface.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass direct and indirect mountings, connections, supports, and couplings. Further, "connected" and "coupled" are not restricted to physical or mechanical connections or couplings.

Figure 1:
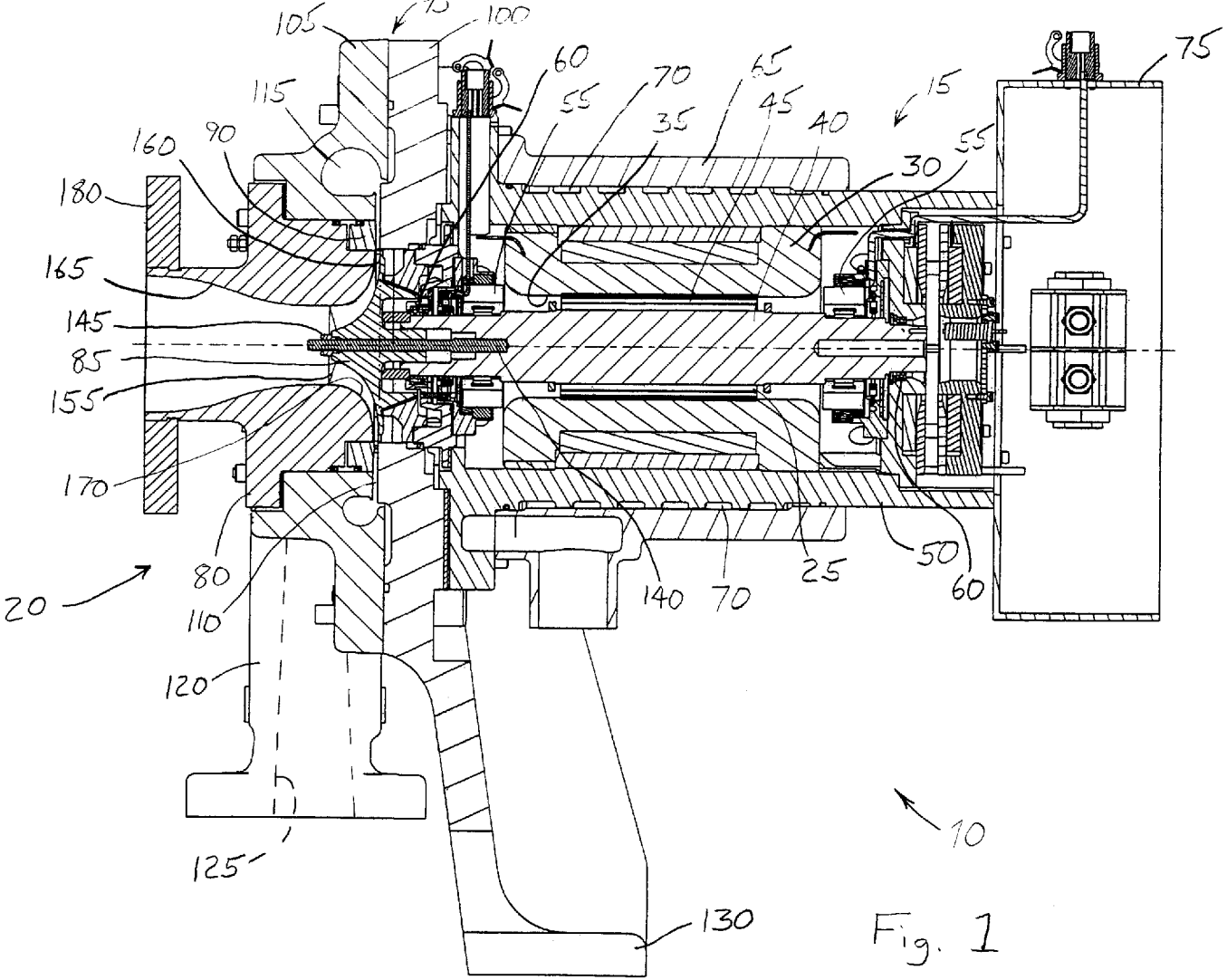
FIG. 1 is a cross section view of a fluid compression system embodying the invention and taken through an axis of rotation.

FIG. 1 illustrates a fluid compression system 10 that includes a prime mover, such as a motor 15 coupled to a compressor 20 and operable to produce a compressed fluid. In the illustrated construction, an electric motor 15 is employed as the prime mover. However, other constructions may employ other prime movers such as but not limited to internal combustion engines, diesel engines, combustion turbines, etc.

The electric motor 15 includes a rotor 25 and a stator 30 that defines a stator bore 35. The rotor 25 is supported for rotation on a shaft 40 and is positioned substantially within the stator bore 35. The illustrated rotor 25 includes permanent magnets 45 that interact with a magnetic field produced by the stator 30 to produce rotation of the rotor 25 and the shaft 40. The magnetic field of the stator 30 can be varied to vary the speed of rotation of the shaft 40. Of course, other constructions may employ other types of electric motors (e.g., synchronous, induction, brushed DC motors, etc.) if desired.

The motor 15 is positioned within a housing 50 which provides both support and protection for the motor 15. A bearing 55 is positioned on either end of the housing 50 and is directly or indirectly supported by the housing 50. The bearings 55 in turn support the shaft 40 for rotation. In the illustrated construction, magnetic bearings 55 are employed with other bearings (e.g., roller, ball, needle, etc.) also suitable for use. In the construction illustrated in FIG. 1, secondary bearings 60 are employed to provide shaft support in the event one or both of the magnetic bearings 55 fail.

In some constructions, an outer jacket 65 surrounds a portion of the housing 50 and defines cooling paths 70 therebetween. A liquid (e.g., glycol, refrigerant, etc.) or gas (e.g., air, carbon dioxide, etc.) coolant flows through the cooling paths 70 to cool the motor 15 during operation.

An electrical cabinet 75 may be positioned at one end of the housing 50 to enclose various items such as a motor controller, breakers, switches, and the like. The motor shaft 40 extends beyond the opposite end of the housing 50 to allow the shaft to be coupled to the compressor 20.

The compressor 20 includes an intake housing 80 or intake ring, an impeller 85, a diffuser 90, and a volute 95. The volute 95 includes a first portion 100 and a second portion 105. The first portion 100 attaches to the housing 50 to couple the stationary portion of the compressor 20 to the stationary portion of the motor 15. The second portion 105 attaches to the first portion 100 to define an inlet channel 110 and a collecting channel 115. The second portion 105 also defines a discharge portion 120 that includes a discharge channel 125 that is in fluid communication with the collecting channel 115 to discharge the compressed fluid from the compressor 20.

In the illustrated construction, the first portion 100 of the volute 95 includes a leg 130 that provides support for the compressor 20 and the motor 15. In other constructions, other components are used to support the compressor 20 and the motor 15 in the horizontal position. In still other constructions, one or more legs, or other means are employed to support the motor 15 and compressor 20 in a vertical orientation or any other desired orientation.

The diffuser 90 is positioned radially inward of the collecting channel 115 such that fluid flowing from the impeller 85 must pass through the diffuser 90 before entering the volute 95. The diffuser 90 includes aerodynamic surfaces 135 (e.g., blades, vanes, fins, etc.), shown in FIG. 2, arranged to reduce the flow velocity and increase the pressure of the fluid as it passes through the diffuser 90.

The impeller 85 is coupled to the rotor shaft 40 such that the impeller 85 rotates with the motor rotor 25. In the illustrated construction, a rod 140 threadably engages the shaft 40 and a nut 145 treadably engages the rod 140 to fixedly attach the impeller 85 to the shaft 40. The impeller 85 extends beyond the bearing 55 that supports the motor shaft 40 and, as such is supported in an cantilever fashion. Other constructions may employ other attachment schemes to attach the impeller 85 to the shaft 40 and other support schemes to support the impeller 85. As such, the invention should not be limited to the construction illustrated in FIG. 1. Furthermore, while the illustrated construction includes a motor 15 that is directly coupled to the impeller 85, other constructions may employ a speed increaser such as a gear box to allow the motor 15 to operate at a lower speed than the impeller 85.

The impeller 85 includes a plurality of aerodynamic surfaces or blades 150 that are arranged to define an inducer portion 155 and an exducer portion 160. The inducer portion 155 is positioned at a first end of the impeller 85 and is operable to draw fluid into the impeller 85 in a substantially axial direction. The blades 150 accelerate the fluid and direct it toward the exducer portion 160 located near the opposite end of the impeller 85. The fluid is discharged from the exducer portion 160 in at least partially radial directions that extend 360 degrees around the impeller 85.

The intake housing 80, sometimes referred to as the intake ring, is connected to the volute 95 and includes a flow passage 165 that leads to the impeller 85. Fluid to be compressed is drawn by the impeller 85 down the flow passage 165 and into the inducer portion 155 of the impeller 85. The flow passage 165 includes an impeller interface portion 170 that is positioned near the blades 150 of the impeller 85 to reduce leakage of fluid over the top of the blades 150. Thus, the impeller 85 and the intake housing 80 cooperate to define a plurality of substantially closed flow passages 175.

In the illustrated construction, the intake housing 80 also includes a flange 180 that facilitates the attachment of a pipe or other flow conducting or holding component. For example, a filter assembly could be connected to the flange 180 and employed to filter the fluid to be compressed before it is directed to the impeller 85. A pipe would lead from the filter assembly to the flange 180 to substantially seal the system after the filter and inhibit the entry of unwanted fluids or contaminates.

Figure 2:
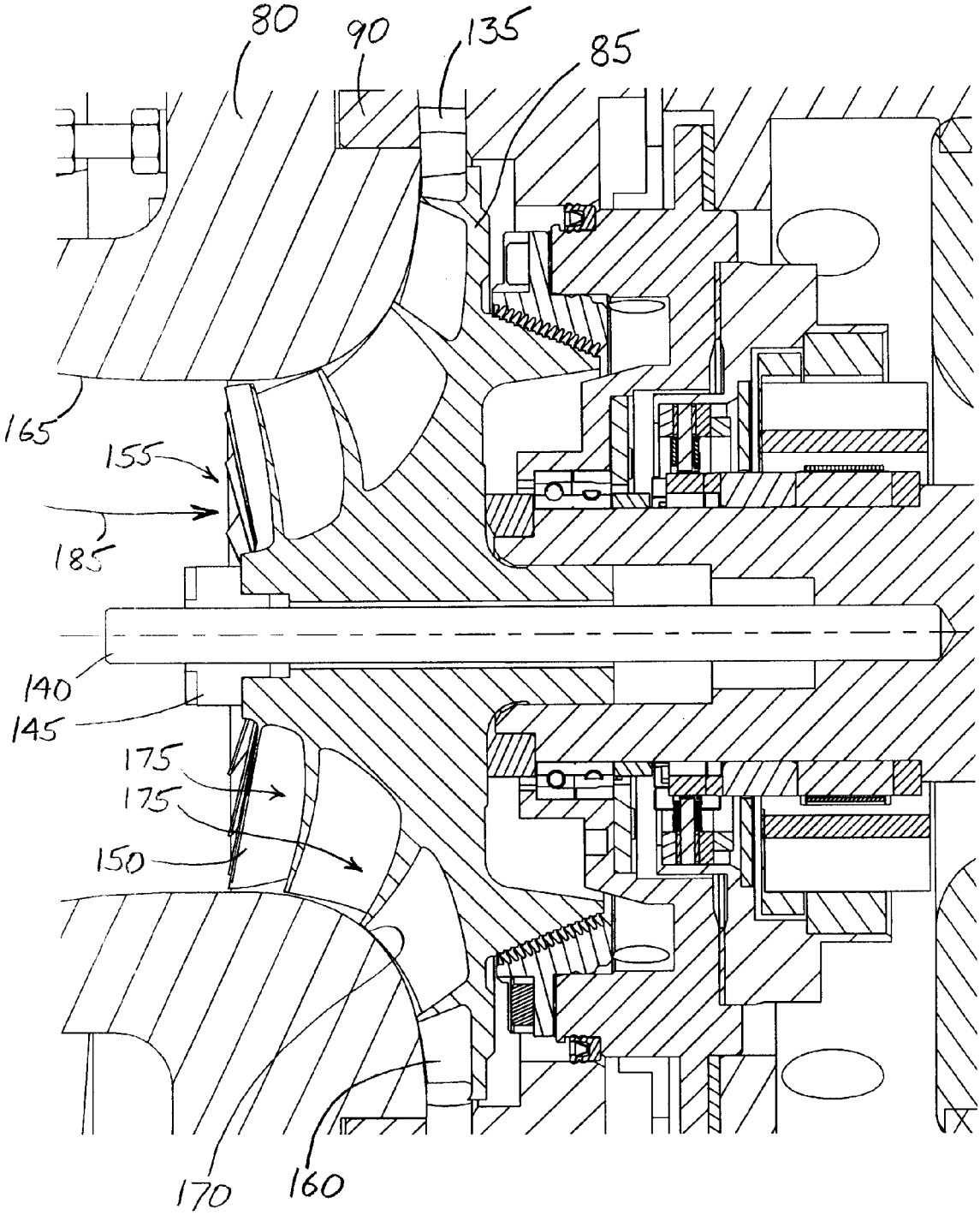
FIG. 2 is an enlarged cross section view of an impeller of the fluid compression system of FIG. 1.

Turning to FIG. 2, the impeller 85 is illustrated in greater detail. The inducer portion 155 is substantially annular and draws fluid along an intake path 185 into the impeller 85. The fluid enters in a substantially axial direction and flows through the passages 175 defined between adjacent blades 150 to the exducer portion 160.

Figure 3:
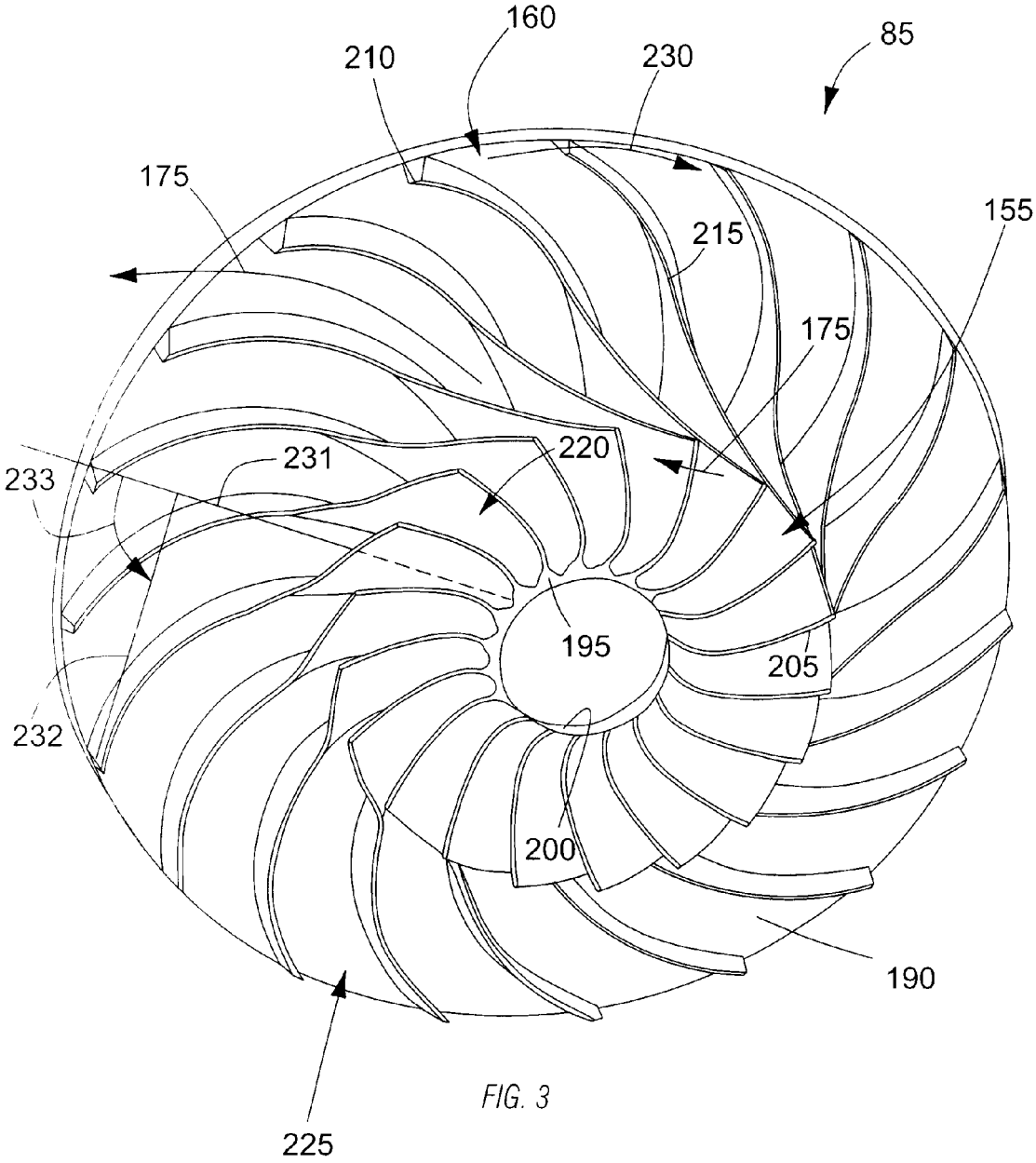
FIG. 3 is a perspective view of the impeller of FIG. 2.

As illustrated in FIG. 3, the impeller 85 includes a backplate 190, or platform, having a central hub 195, or hub portion, and a bore 200 extending through the hub 195. The central bore 200 receives the rod 140 to facilitate attachment of the impeller 85 to the motor 15. Each of the blades 150 extends from the platform 190 and includes a leading edge 205 in the inducer portion 155 and a trailing edge 210 in the exducer portion 160. A blade tip 215 extends between the leading edge 205 and the trailing edge 210 opposite the platform 190. During operation, the blade tip 215 is disposed adjacent the intake housing 80 such that the intake housing 80, the blades 150, and the platform 190 cooperate to define the plurality of substantially closed flow passages 175. Each of the flow passages 175 includes an inlet 220 at the inducer portion 155 and an outlet 225 at the exducer portion 160. The arrangement illustrated in FIG. 3 is commonly referred to as a semi-closed impeller 85.

FIG. 3 also illustrates the blade wrap of each of the blades. Blade wrap is an indication of the shape of the blade and is measured in terms of angles with positive angles indicating a wrap toward the direction of rotation and negative numbers indicating a wrap away from the direction of rotation. The mid-line wrap (i.e., the wrap measured at the midline of the blade) is measured using a straight line tangent to the blade at the leading edge near the hub as a reference. A first line 231 is shown tangent to the blade at the mid-line near the hub with a second line 232 shown tangent to the mid-line of the blade near the trailing edge. As can be seen, the angle 233 between the first line and the second line is between about −65 degrees and −90 degrees. As one of ordinary skill in the art will realize, the blade wrap angle varies depending on the streamline plane on which the angle is measured. However, in a preferred construction, all of the blade wrap angles are between about −65 degrees and −90 degrees.

Figure 4:
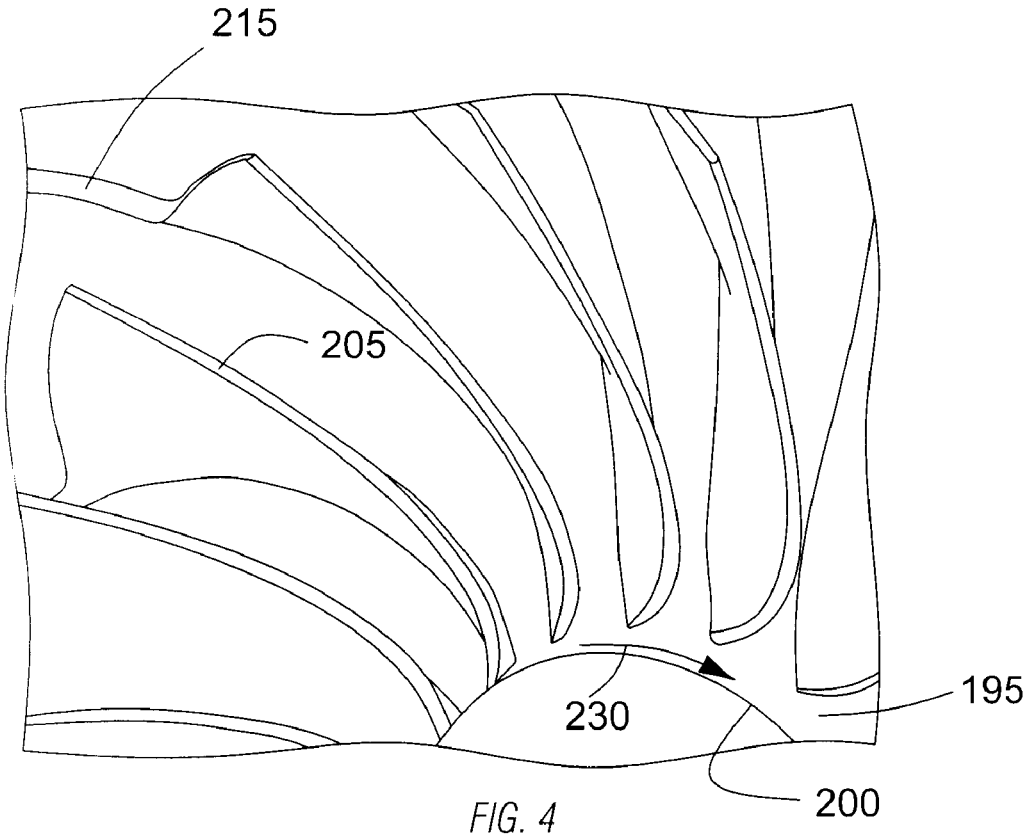
FIG. 4 is an enlarged perspective view of an inductor portion of the impeller of FIG. 2.

Turning to FIG. 4, the leading edge 205 of a portion of the blades 150 is illustrated in greater detail. As can be seen, the leading edge 205 extends from the hub 195 and follows a backward sweeping non-linear curve (i.e., sweeping away from a direction of rotation 230). In other words, the leading edge 205 of each blade is bowed and swept. The curved leading edge 205 reduces entrance losses during operation and increases the flow capacity when compared to a similarly-sized prior art impeller.

Figure 5:
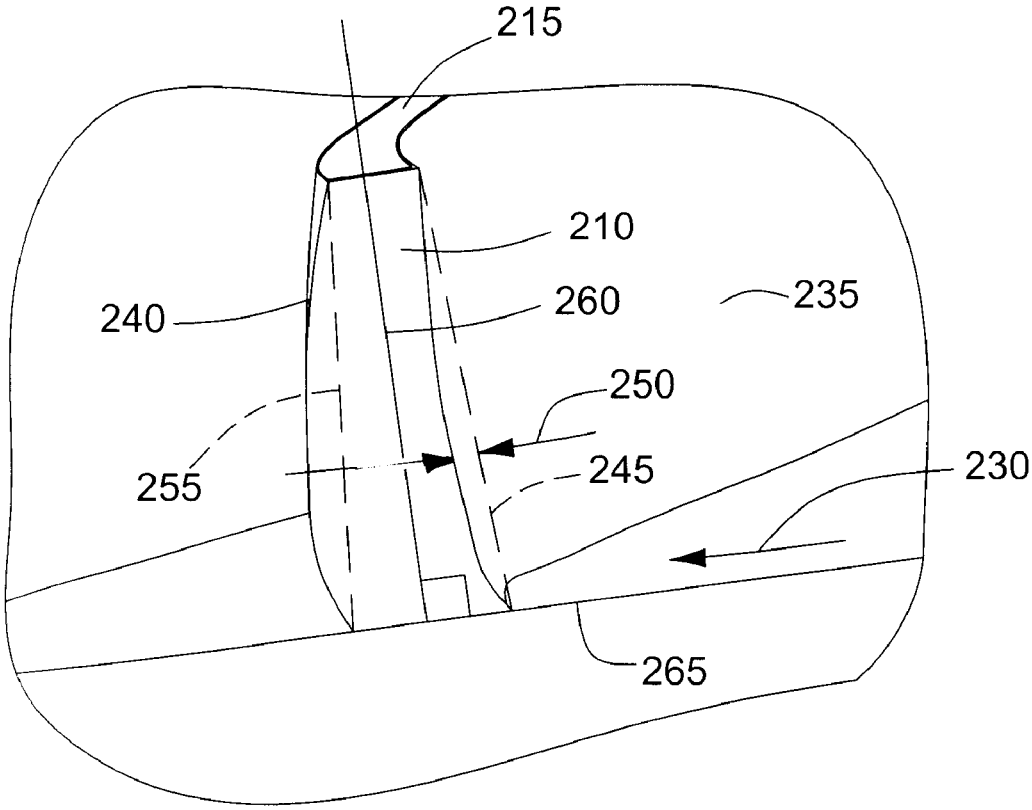
FIG. 5 is an end view of a blade of the impeller of FIG. 2.

With reference to FIG. 5, the trailing edge 210 of one blade 150 is illustrated. The blade 150 includes a suction side 235 that is generally concave, and a pressure side 240 that is generally convex. The concave suction side 235 is concave in a direction that extends from the platform 190 to the blade tip 215. Thus, the portion of the blade 150 adjacent the platform 190 and the blade tip 215 define a surface that is spaced a non-zero distance from the middle portion of the blade 150. FIG. 5 illustrates the end of this surface as a line 245. As can be seen, the middle portion of the blade 150 is spaced a non-zero distance 250 from the blade 150. Conversely, a second surface that passes through the portion of the blade 150 adjacent the platform 190 and the blade tip 215 on the convex pressure side 240 of the blade 150 crosses through the middle portion of the blade 150. FIG. 5 illustrates the end of the second surface as a second line 255. As can be seen, the middle portion of the pressure side 240 of the blade 150 crosses the line 255 in the middle portion of the blade 150. One suction side 235 cooperates with the pressure side 240 of an adjacent blade 150, the platform 190, and the intake housing 80 to define one of the substantially enclosed flow passages 175. It should also be noted that in general, the pressure side 240 and the suction side 235 are not parallel to one another. As shown in FIG. 5, the pressure side 240 and the suction side 235 are not parallel at the trailing edge 210.

In addition to the non-planar suction side 235 and pressure side 240, the blade tip 215 is backward leaning. FIG. 5 illustrates an axis 260 that extends normal to a line 265 that represents the plane of the platform 190 at the trailing edge 210. The axis 260 passes through the center of the trailing edge 210 adjacent the platform 190. However, at the blade tip 215, a greater percentage of the blade 150 is disposed on the backward side (i.e., the side away from the direction of rotation 230) or suction side 235 of the blade 150. Thus, the blade 150 is said to be backward leaning.

During operation, the blades 150 cooperate to produce a primary flow of fluid that generally follows the flow passages 175 between adjacent blades 150. However, there is generally a small secondary flow that departs from the more orderly flow path of the primary flow. The greater the secondary flow, the greater the inefficiencies in the impeller 85. The backward lean of the blades 150 tends to force the secondary flow toward the platform 190 and the base of the blades 150, thereby reducing leakage between the blade tip 215 and the intake housing 80 and improving the efficiency of the impeller 85.

The use of concave suction sides 235 and convex pressure sides 240, along with the other geometric features described herein promote a uniform pressure rise along the length of the flow passages 175 (i.e., from the inlet 220 to the outlet 225), thus further improving efficiency.

Figure 6:
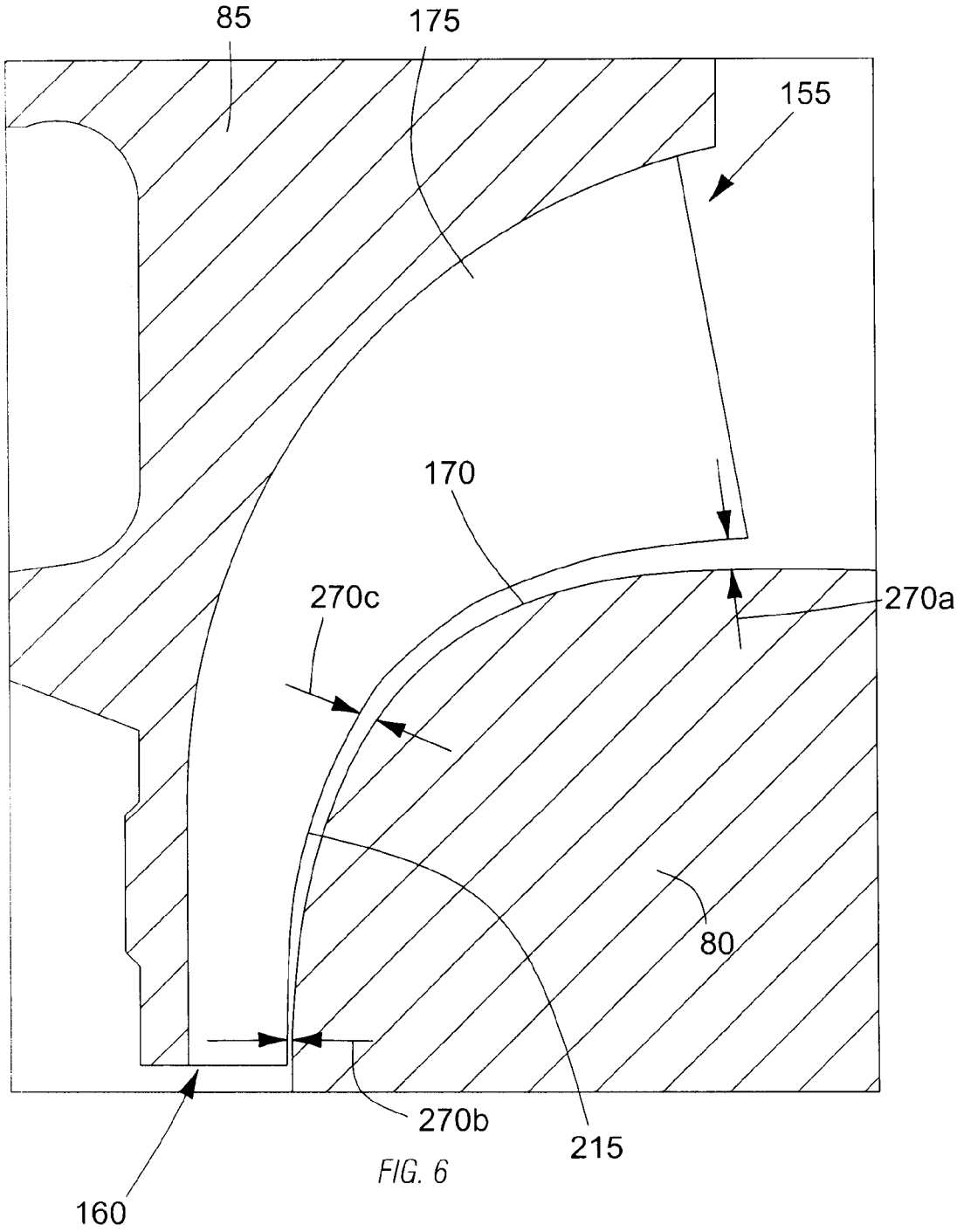
FIG. 6 is an enlarged view of the impeller and intake housing illustrating the clearance therebetween.

FIG. 6 illustrates a portion of the impeller 85 positioned adjacent the intake housing 80 to better illustrate a clearance therebetween. During impeller operation, flow can leak between the blade tips 215 and the intake housing 80, thus reducing impeller efficiency. As such, a small clearance is generally maintained between these two components. However, too small of a clearance may allow unwanted contact or rubs during unusual operating circumstances, while too great a clearance results in excessive leakage. As shown in FIG. 6, the compressor system employs a non-uniform clearance gap 270. More specifically, a first gap 270*a* near the inducer portion 155 is larger than a second gap 270*b* near the exducer portion 160. A third gap 270*c* between the inducer portion 155 and the exducer portion 160 is larger than the gap 270*b* near the exducer portion and is smaller than the gap 270*a* near the inducer portion. Thus, the cap continuously increases in size from the inducer to the exducer. Before proceeding, it should be noted that the size and variation of the gap 270 is exaggerated in FIG. 6 for illustrative purposes. In preferred constructions, the clearance is defined by a high-order curve (i.e. second order, third order, etc.).

The gap 270 is related to a velocity loading parameter defined by the impeller 85 during operation. As one of ordinary skill will realize, the velocity loading parameter is a function of the relative velocity between the fluid within the impeller 85 and the impeller 85 itself. Generally, the velocity loading parameter is low near the inducer portion 155 and rises to a peak value near the exducer portion 160. In preferred constructions, the gap 270 is inversely related to the velocity loading parameter. More specifically, the gap 270*a* near the inducer portion 155 is larger than the gap 270*c* near the exducer portion, as the velocity loading is lowest near the inducer portion 155 and highest near the exducer portion 160.

In operation, power is provided to the motor 15 to produce rotation of the shaft 40 and the impeller 85. As the impeller 85 rotates, fluid to be compressed is drawn into the intake housing 80 and into the inducer portion 155 of the impeller 85. The impeller 85 accelerates the fluid from a velocity near zero to a high velocity at the exducer portion 160. In addition, the impeller 85 produces an increase in pressure between the inducer 155 and the exducer 160. As the flow passes through the flow passages 175 between the blades 150, the backward leaning blades 150 reduce the amount of flow near the blade tips 215, thus reducing the amount of flow available to leak between the blade tips 215 and the intake housing 80. Additionally, as the fluid flows along the flow passages 175 and the velocity loading increases, the gap between the intake housing 80 and the blade tips 215 is reduced, thus further reducing leakage and improving efficiency.

After passing through the impeller 85, the fluid enters the diffuser 90. The diffuser 90 acts on the fluid to reduce the velocity. The velocity reduction converts the dynamic energy of the flow of fluid into potential energy or high pressure. The now high-pressure fluid exits the diffuser 90 and inters the volute 95 via the inlet channel 110. The high-pressure fluid then passes into the collecting channel 115 which collects fluid from any angular position around the inlet channel 110. The collecting channel 115 then directs the high-pressure fluid out of the volute 95 via the discharge channel 125. Once discharged from the volute 95, the fluid can be passed to different components including but not limited to a drying system, an inter-stage heat exchanger, another compressor, a storage tank, a user, an air use system, etc.

Thus, the invention provides, among other things, a compressor system 10 that includes an impeller 85 having aerodynamic surfaces arranged to improve the performance of the impeller 85. Various features and advantages of the invention are set forth in the following claims.

What is claimed is:

1. An impeller rotatable in a direction of rotation in a centrifugal compressor having an intake ring, the impeller comprising:

a back plate including a hub portion; and a plurality of blades extending from the backplate, each blade including an inducer portion leaning toward the direction of rotation with respect to the remainder of the blade and including a leading edge that extends radially outward along a non-linear path from adjacent the hub portion.

2. The impeller of claim 1, wherein the non-linear path is backward sweeping.

3. The impeller of claim 2, wherein the plurality of blades define an exducer portion adapted to discharge the fluid, the exducer portion including a trailing edge of each of the blades.

4. The impeller of claim 1, wherein each blade defines a blade tip, and wherein at least a portion of the blade tip leans in a direction opposite the direction of rotation.

5. The impeller of claim 1, wherein each of the plurality of blades defines a blade pressure side that extends from the leading edge to the trailing edge and is convex.

6. The impeller of claim 5, wherein each of the plurality of blades defines a blade suction side opposite the pressure side and extending from the leading edge to the trailing edge, the suction side being concave.

7. The impeller of claim 1, wherein the back plate and the plurality of blades are integrally-formed as a single component from a single contiguous piece of material.

8. The impeller of claim 1, wherein each blade defines a blade tip, and wherein the intake ring and blade tips cooperate to define a non-uniform clearance gap therebetween.

9. The impeller of claim 8, wherein the non-uniform clearance gap is defined by a high-order equation.

10. The impeller of claim 1, wherein each of the blades defines a blade mid-line wrap of between about −65 degrees to −90 degrees.

11. An impeller rotatable in a direction of rotation in a centrifugal compressor including an intake ring, the impeller comprising:

a back plate including a hub portion; and a plurality of blades, each extending from the back plate and including:

an inducer portion adapted to draw fluid into the impeller and including a leading edge, an exducer portion adapted to discharge the fluid from the impeller and including a trailing edge;

a blade pressure side defined between the leading edge, the trailing edge, the back plate, and a blade tip, the pressure side being convex from the back plate to the blade tip; and a blade suction side opposite the pressure side and defined between the leading edge, the trailing edge, the back plate, and the blade tip, the suction side being concave from the back plate to the blade tip.

12. The impeller of claim 11, wherein at least a portion of the blade tip leans in a direction opposite the direction of rotation.

13. The impeller of claim 11, wherein the back plate and the plurality of blades are integrally-formed as a single component from a single contiguous piece of material.

14. The impeller of claim 11, wherein the leading edge of each blade extends radially outward from the hub portion along a non-linear path.

15. The impeller of claim 14, wherein the non-linear path is rearward sweeping.

16. The impeller of claim 11, wherein the trailing edge includes a non-linear pressure side edge and a non-linear suction side edge that is not parallel to the pressure side edge.

17. The impeller of claim 11, wherein the blade tip and the intake ring cooperate to define a non-uniform clearance gap therebetween.

18. The impeller of claim 17, wherein the non-uniform clearance gap is defined by a high-order equation.

19. The impeller of claim 11, wherein each of the blades defines a blade mid-line wrap of between about −65 degrees to −90 degrees.

20. A centrifugal compressor comprising:

an impeller rotatable in a direction of rotation about an axis and including a plurality of blades that define an inducer portion adapted to draw in fluid during rotation and an exducer portion adapted to discharge the fluid during rotation, each of the blades including a leading edge, a trailing edge, a platform portion, and a blade tip; and an intake ring having a seal surface disposed adjacent the blade tip to define a clearance gap, the seal surface and the blade tip arranged such that the gap is non-uniform when measured normal to the seal surface, wherein the blade tip leans in a direction opposite the direction of rotation.

21. The centrifugal compressor of claim 20, wherein the impeller includes a shaft portion and wherein each leading edge extends radially outward along a non-linear path from the shaft portion.

22. The centrifugal compressor of claim 21, wherein the non-linear path is backward sweeping.

23. The centrifugal compressor of claim 20, wherein each blade includes a blade pressure side defined between the leading edge, the trailing edge, the platform portion, and the blade tip, the pressure surface being convex from the platform portion to the blade tip.

24. The centrifugal compressor of claim 20, wherein each blade includes a blade suction side defined between the leading edge, the trailing edge, the platform portion, and the blade tip, the suction surface being concave from the platform portion to the blade tip.

25. The centrifugal compressor of claim 20, wherein the clearance gap is larger adjacent the inducer portion than between the inducer portion and the exducer portion and adjacent the exducer portion.

26. The centrifugal compressor of claim 20, wherein the impeller defines a velocity loading parameter during operation, and wherein the clearance gap is inversely related to the velocity loading parameter.

27. The centrifugal compressor of claim 20, wherein each of the blades defines a blade mid-line wrap of between about −65 degrees to −90 degrees.

28. A centrifugal compressor comprising:

an impeller rotatable in a direction of rotation about an axis and including a plurality of blades that define an inducer portion adapted to draw in fluid during rotation and an exducer portion adapted to discharge the fluid during rotation, each of the blades including a leading edge, a trailing edge, a platform portion, and a blade tip; and an intake ring having a seal surface disposed adjacent the blade tip to define a clearance gap, the seal surface and the blade tip arranged such that the gap is non-uniform when measured normal to the seal surface, wherein the trailing edge includes a non-linear pressure side edge and a non-linear suction side edge that is not parallel to the pressure side edge.

* * * * *